United States Patent [19]

Litzinger

[11] 4,040,856

[45] Aug. 9, 1977

[54] PRODUCTION OF DISCRETE CELLULOSE ACETATE FIBERS BY EMULSION FLASHING

[75] Inventor: Paul C. Litzinger, Camas, Wash.

[73] Assignee: Crown Zellerbach Corporation, San Francisco, Calif.

[21] Appl. No.: 587,772

[22] Filed: June 17, 1975

[51] Int. Cl.[2] ..... C08L 1/08

[52] U.S. Cl. ..... 106/170; 106/187; 106/196; 106/203; 162/157 R; 264/13; 264/207; 264/211

[58] Field of Search ..... 264/207, 13, 211, 140; 106/170, 196, 203, 187; 162/157 R

[56] References Cited

U.S. PATENT DOCUMENTS

| | | | |
|---|---|---|---|
| 1,996,120 | 4/1935 | Payne et al. | 264/207 |
| 2,075,890 | 4/1937 | Dreyfus | 264/207 |
| 2,695,835 | 11/1954 | Hare | 264/207 |
| 2,988,469 | 6/1961 | Watson | 264/12 |
| 3,342,921 | 9/1967 | Brundige et al. | 264/12 |
| 3,482,011 | 12/1969 | Bohrer | 264/207 |
| 3,674,736 | 7/1972 | Lerman et al. | 260/41 R |
| 3,740,940 | 6/1973 | Berkowitch | 57/140 R |
| 3,770,856 | 11/1973 | Ueki et al. | 264/13 |
| 3,808,091 | 4/1974 | Aoki et al. | 264/13 |
| 3,952,081 | 4/1976 | Epstein et al. | 264/207 |

*Primary Examiner*—Jay H. Woo

*Attorney, Agent, or Firm*—Stanley M. Teigland; Corwin R. Horton

[57] ABSTRACT

Discrete cellulose acetate fibers are produced by flashing an emulsion of cellulose acetate, water, and a solvent which is miscible with the water at the temperature at which the emulsion is flashed. The fibers can be used directly to make paper in accordance with conventional papermaking methods.

6 Claims, 5 Drawing Figures

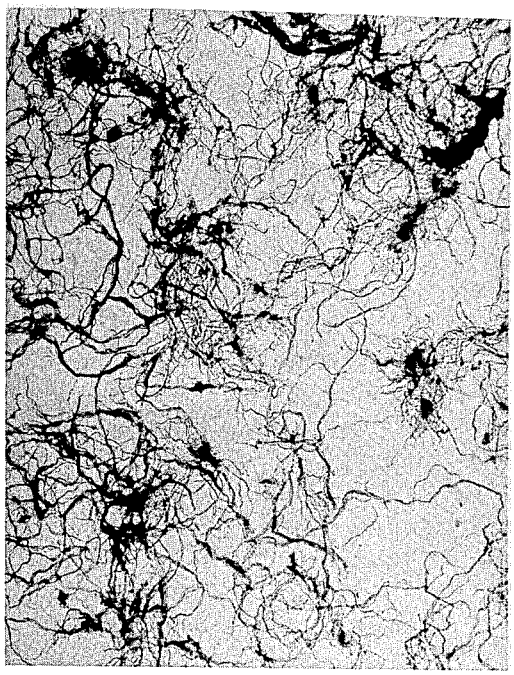
FIG. 3 ⊢ 1.mm ⊣
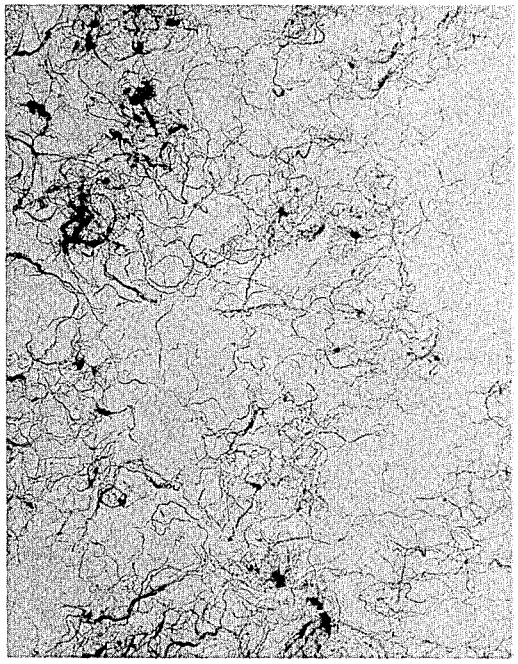
FIG. 4 ⊢ 1.mm ⊣
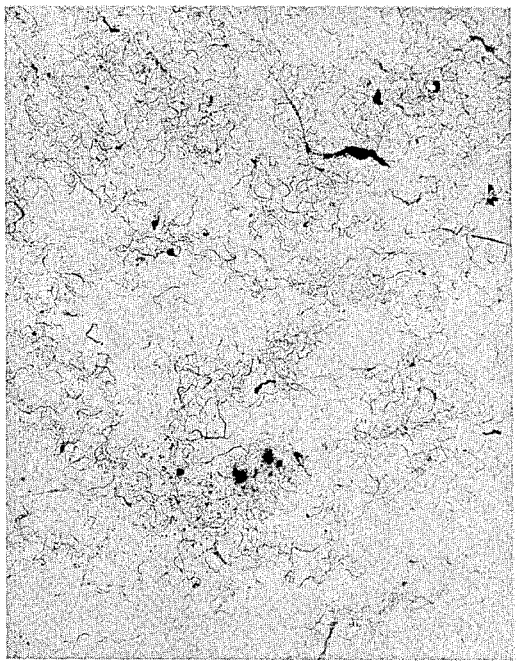
FIG. 5 ⊢ 1.mm ⊣

PRODUCTION OF DISCRETE CELLULOSE ACETATE FIBERS BY EMULSION FLASHING

In accordance with this invention, discrete cellulose alkanoate fibers are produced by passing through a nozzle into a zone of lower pressure an emulsion of a cellulose alkanoate, water and a solvent for the cellulose alkanoate which is miscible with the water in the emulsion at the temperature at which the cellulose alkanoate is passed through the nozzle. The reduction of pressure on the emulsion causes the solvent to vaporize rapidly. Vaporization of the solvent causes the temperature of the mixture to drop. The drop in temperature together with the loss of solvent causes the cellulose alkanoate to soldify. The shear imparted by the nozzle causes the cellulose alkanoate to solidify as discrete fibers.

For convenience, the step of passing the emulsion through the nozzle will be referred to as "flashing"; and the space into which the emulsion is flashed will be referred to as the "flash zone".

The invention is based on the discovery that an emulsion capable of forming fibers by flashing can be prepared from a cellulose alkanoate, water and a solvent which is miscible with the water in the emulsion at the temperature at which the emulsion is flashed. This discovery is surprising in itself. One would expect the mixture to form either a homogenous solution or a suspension of solid particles of cellulose alkanoate in a water-solvent medium, depending upon the particular conditions. For example, cellulose acetate is soluble in a system of equal volumes of water and acetone to the extent of about 10 percent at 150° C. The addition of more water or cooling of the solution would be expected to cause the cellulose acetate to precipitate directly as a solid. However, the mixture actually passes through an intermediate state before the cellulose acetate precipitates as a solid. This is best explained by reference to the drawings.

Figure 1:
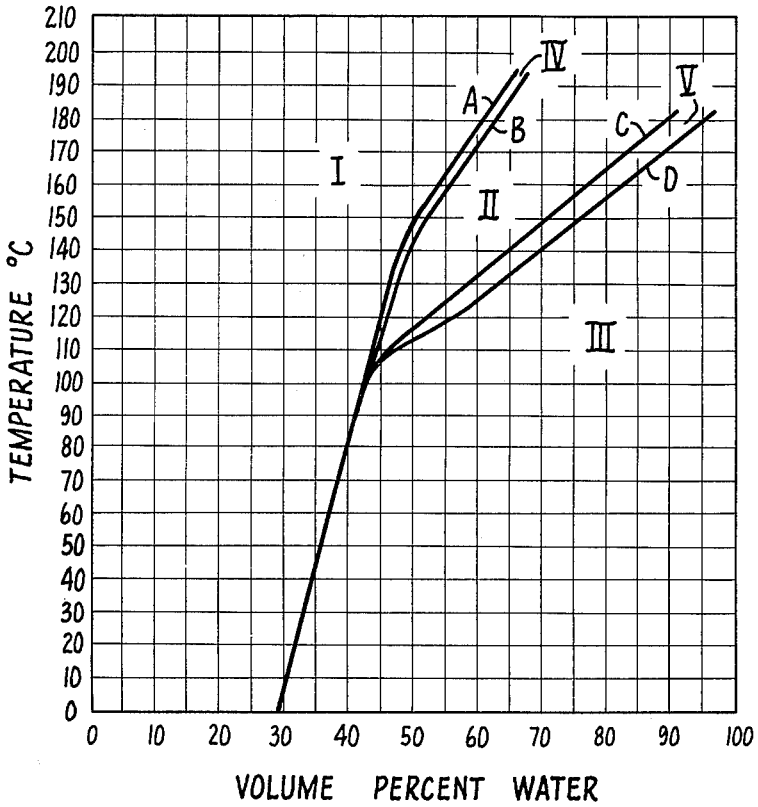
FIG. 1 is a graph showing the types of mixtures formed by 10 parts by weight (grams) of cellulose acetate in 100 parts by volume (milliliters) of water and acetone at various temperatures and various relative proportions of water and acetone.

Referring to FIG. 1, mixtures in area I (above line A) are homogenous solution; mixtures in area III (below line D) contain solid particles of cellulose acetate; and mixtures in area II (between lines B and C) contain droplets of solvent-plasticized cellulose acetate. For example, consider a mixture of 10 weight/volume percent cellulose acetate in equal volumes of acetone and water. The abscissa of the mixture is always 50 in FIG. 1; and the ordinate is the temperature of the mixture. At temperatures below about 110° C, the mixture contains solid particles of cellulose acetate (area III). When the temperature of the mixture is raised to between about 118° C and 145° C, it contains liquid droplets of solvent-plasticized cellulose acetate and no longer contains solid particles (area II). When the temperature is further raised to above about 150° C, it exists as a homogeneous solution (area I).

Figure 2:
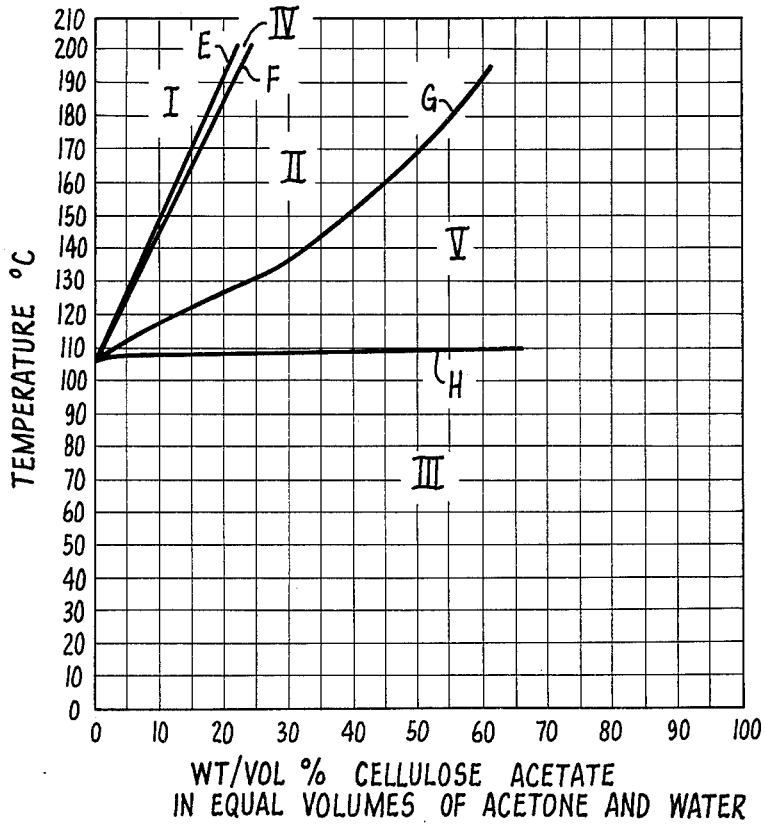
FIG. 2 is a graph showing the types of mixtures formed by cellulose acetate, water and acetone at various temperatures and various concentrations of cellulose acetate in equal volumes of acetone and water.

Referring to FIG. 2, mixtures in area I (above line E) are homogenous solutions; mixtures in area III (below line H) contain solid particles of cellulose acetate; and mixtures in area II (between lines F and G) contain droplets of solvent-plasticized cellulose acetate.

In both FIGS. 1 and 2, areas IV and V represent transition states. As a mixture containing suspended solid particles of cellulose acetate (area III) is heated, it passes through a transition state (area V) in which some of the particles form solvent-plasticized droplets while the remainder remain as solid particles. After passing through the transistion state, the mixture no longer contains solid particles of cellulose acetate. As the mixture, which now appears as an emulsion of solvent-plasticized droplets (area II), is further heated, it passes through another transition state (area IV) in which some of the droplets dissolve into the continuous phase while the remainder remain as droplets. After passing through the second transition state, the mixture exists as a homogeneous solution (area I), which contains neither solid particles nor droplets.

In the practice of this invention, the mixture is between the two transition states; i.e., it appears as a emulsion of liquid droplets of solvent-plasticized resin. As the droplets pass through the nozzle, they are formed into fibers. Such emulsions can be prepared simply by mixing and heating the three necessary components. Neither special mixing techniques nor surfactants are required, but a surfactant may be added if desired.

Suitable cellulose alkanoates include cellulose acetate, cellulose triacetate, cellulose acetate butyrate (butyryl content 10 to 60% by weight), and cellulose acetate propionate (propionyl content 10 to 60% ). Cellulose acetate is preferred. Cellulose acetate has an acetic acid content of from about 52 to 62%, preferably 54 to 56%, and preferably is soluble in acetone.

The solvent has a boiling point at atmospheric pressure of less than 100° C, preferably less than 80° C and more preferably less than 60° C. Suitable solvents for cellulose acetate include methanol, ethanol, methyl ethyl ketone, and acetone. Acetone is preferred.

The proportion of solvent in the emulsion can range from about 1 to 60% by volume based on the total volume of water and solvent. Preferably, the proportion of solvent is from about 20 to 60 volume percent.

The concentration of the cellulose alkanoate can be any concentration at which the mixture appears as an emulsion of solvent-plasticized liquid droplets of cellulose alkanoate in a continuous water-solvent phase at the temperature of the emulsion. This concentration can range from about 5 to about 70%, and preferably is from about 10 to 30 percent, by weight based on the volume of water and solvent. (The weight and volume units are understood to be kilograms and liters, respectively; and the volume units, for this purpose and for the purpose of determining volume percent, are understood to be measured at room temperature).

There can be added to the emulsion conventional polymer additives such as flame retardants, optical brightners, pigments, clay, carbon black, and other fillers and additives which are retained by the cellulose alkanoate.

The temperature of the emulsion is that temperature at which the emulsion is between the two transtition states. As can be seen from FIGS. 1 and 2, this temperature generally ranges from about 120° to 200° C. The temperature of the emulsion is also such that the emulsion has sufficient enthalpy to cause rapid vaporization of the solvent upon flashing. To provide such enthalpy, the temperature of the emulsion is preferably at least 60° C above the normal boiling point of the solvent. For example, by maintaining the flash zone at an appropriate pressure, which may be less than atmospheric, an emulsion having a temperature as low as 120° C would have sufficient enthalpy to provide the required heat of vaporization for a solvent having a normal boiling point of about 60° C or less. The temperature of the emulsion is preferably from about 120 to 170° C.

The pressure in the vessel containing the emulsion is preferably autogenous, which normally is sufficient to force the emulsion through the nozzle with the shear required to form the fibers. The pressure may be maintained constant during flashing by introducing an inert gas, such as nitrogen, into the vessel. Similarly, an inert gas may be used to develop an initial pressure greater than the autogenous pressure, such as up to about 20 kg/cm$^2$ or more, prior to flashing.

The pressure in the flash zone is such that vaporization of the solvent causes the cellulose alkanoate to solidify as discrete fibers. For a particular composition, this pressure can be determined by simple experimentation, or may be calculated with the aid of graphs such as FIGS. 1 and 2. For example, the pressure would be that which would cause sufficient solvent to vaporize that the temperature of, and the proportion of solvent remaining in, the mixture would be such that the mixture would lie in area III of the appropriate graph. The appropriate graph can be constructed from simple solubility determinations, and the pressure required in the flash zone can readily be calculated from known thermodynamic data.

A pressure in the flash zone of about atmospheric is normally sufficient when the temperature of the emulsion is at least 60° C above the normal boiling point of the solvent. However, to promote vaporization of the solvent, the flash zone is preferably maintained at less than atmospheric pressure.

Flashing is preferably carried out adiabatically, but may be carried out nonadiabatically, such as by cooling the flash zone, if desired.

Suitable apparatus for carrying out the process of this invention is disclosed in U.S. Pat. No. 3,920,508 . However, an important difference between the process of this invention and other processes for forming discrete fibers by flashing, such as disclosed in the above patent specification, is that in the process of this invention the solvent is miscible rather than immiscible with water. A water-immiscible solvent was employed in the prior art in order to maintain the polymer in the dissolved state. If a water-miscible solvent was employed, the water in the system would destroy the solvating power of the solvent. However, in connection with this invention it was discovered that under certain conditions the addition of water does not cause a cellulose alkanoate to precipitate directly as a solid as would be expected, but as a solvent-plasticized liquid. While most of the solvent is of course in the aqueous phase, a sufficient amount of the solvent infiltrates the cellulose alkanoate to liquify it, which is surprising.

Although the emulsion from which the fibers are produced is different, the fibers of this invention are morphologically somewhat similar to the polyolefin fibers described in U.S. Pat No. 3,920,508, except the fibers of this invention are generally finer and, under magnification, have a more fiber-like as opposed to film-like, appearance.

The fibers of this invention are especially suitable for making paper by conventional papermaking methods. The fibers can be used either alone or mixed in any proportion with other papermaking fibers. Moreover, the fibers can be made into paper directly after flashing without refining. However, if desired the fibers can be beaten or refined in accordance with conventional methods to adjust the fiber length and degree of fibrillation for a particular use.

Before refining, the length of the fibers is between 1 and 10 mm (as measured by TAPPI Test T 232 SU68) when prepared for use in making paper. For other uses, such as in the manufacture of nonwovens, textile threads, insulation material, etc., longer fibers having lengths up to 30 mm may be prepared.

After refining, the fibers have a classified fiber length between 0.4 and 2.0 mm. Generally, the length of fibers produced by flashing can be increased by increasing the concentration of the fiber-forming resin in the emulsion.

The hydrodynamic surface area of the fibers is greater than about one square per gram, and can be as high as 100 square meters per gram or higher. In comparison, cellulose alkanoate fibers prepared by conventional methods have a surface area substantially less than one square meter per gram. The surface area of a fiber is directly related to its ability to form paper by conventional wet-laying techniques.

The average coarseness of the fibers is less than about 25 decigrex, and normally is between about 10 and 20 decigrex. Conventional cellulose alkanoate fibers have a coarseness substantially greater than 25 decigrex.

The fibers are dispersible in water, so it is not necessary to add a dispersing agent to the emulsion or to the fiber after flashing, but a dispersing agent can be added if desired.

EXAMPLE

A 22 liter steam-jacketed vessel was charged with 2.8 liters of acetone and 5.2 liters of water. As the contents were stirred, 0.8 kilogram of cellulose acetate having an acetic acid content of about 55% was added. The vessel was then sealed, purged with nitrogen, and heated from ambient temperature to 143° C with stirring to form an emulsion of acetone-plasticized cellulose acetate in an acetone-water medium. The emulsion was flashed through a nozzle having a diameter of 1.02 mm and a length of 2.86 cm into a receiving vessel. During flashing, the pressure in the stirred vessel was maintained between 180 and 188 psig. The receiving vessel was maintained at subatmospheric pressure by a steam ejector which facilitated vaporization and removal of the acetone. The product was a slurry of discrete fibers in water. The fibers were screened from the water and reslurried in fresh water at a consistency of 1%. The slurry was passed through a disc refiner. Handsheets were made from the refined slurry and from a blend of 50% cellulose acetate fibers and 50% conventional papermaking wood fibers. The properties of the handsheets and the cellulose acetate fibers are reported below.

| Properties of 100% Cellulose Acetate Handsheets | |
|---|---|
| Basis Weight, g/m$^2$ | 62.3 |
| Caliper, mm | 0.126 |
| Density, g/cc | 0.49 |
| Tear Resistance, g/sheet | 6.8 |
| Tensile Strength, kg/15 mm | 1.83 |
| Breaking Length, km | 1.96 |
| Stretch, % | 1.92 |
| Tensile Energy Absorption, kg-cm/cm$^2$ | 0.012 |
| Internal Bond, Scott units | 65.0 |
| Brightness, % | 81.3 |
| Scattering Coefficient | 980.0 |

-continued

| Properties of 100% Cellulose Acetate Handsheets | |
|---|---|
| Opacity, % | 95.3 |

| Properties of 50% Cellulose Acetate Fiber/ 50% Wood Pulp Handsheets | |
|---|---|
| Basis Weight, g/m$^2$ | 61.0 |
| Caliper, mm | 0.102 |
| Density, g/cc | 0.594 |
| Tear Resistance, g/sheet | 26.0 |
| Tensile Strength, kg/15 mm | 3.10 |
| Breaking Length, km | 3.39 |
| Stretch, % | 2.42 |
| Tensile Energy Absorption, kg-cm/cm$^2$ | 0.036 |
| Internal Bond, Scott Units | 168.0 |
| Brightness, % | 77.4 |
| Scattering Coefficient | 719.0 |
| Opacity, % | 91.9 |

| Properties of Cellulose Acetate Fibers | |
|---|---|
| Surface Area, m$^2$/g | 22 |
| Classified Fiber Length, mm | 0.63 |
| Fiber Size Distribution, % | |
| on 20 mesh screen | 0.48 |
| on 35 mesh screen | 7.59 |
| on 65 mesh screen | 34.58 |
| on 150 mesh screen | 21.13 |
| on 270 mesh screen | 11.14 |
| through 270 mesh screen | 25.07 |
| Coarseness, decigrex | 18.2 |
| Drainage Factor, sec$^{-1}$ | 75 |

FIGS. 3, 4 and 5 are photographs, at 20 times magnification, of the fibers collected on the 35, 65 and 150 mesh screen respectively. Although the fibers might appear to be interconnected, they are actually only physically intertwined, with substantially no interstrand bonds being present. Thus, the fibers of this invention are neither continuous nor plexifilamentary.

I claim:

1. A process for producing discrete cellulose alkanoate fibers comprising a. forming a mixture of a substantially water-insoluble cellulose alkanoate, water and a solvent for the cellulose alkanoate, which solvent has a normal boiling point of less than about 100° C, is present in an amount of from about 1 to 60 volume percent based on the volume of water and solvent, and is miscible with the water in the emulsion at the temperature of the emulsion, the concentration of the cellulose alkanoate being such that the mixture appears as an emulsion of solvent-plasticized liquid droplets of cellulose alkanoate in a continuous water-solvent phase at the temperature of the emulsion, the temperature of the emulsion being between about 120° and 200° C and at least 60° C above the normal boiling point of the solvent, and b. passing the emulsion through a nozzle into a zone of lower pressure, the pressure in the zone of lower pressure being such that rapid vaporization of the solvent causes the cellulose alkanoate to solidify as discrete fibers.

2. The process of claim 1 wherein the solvent has a normal boiling point of less than about 80° C.

3. The process of claim 2 wherein the solvent is present in an amount of from about 20 to 60 volume percent.

4. The process of claim 2 wherein the concentration of the cellulose alkanoate is from about 5 to 70% by weight based on the volume of water and solvent.

5. The process of claim 1 wherein the cellulose alkanoate is cellulose acetate or cellulose triacetate.

6. The process of claim 1 wherein the cellulose alkanoate is cellulose acetate soluble in acetone and the solvent is acetone.

* * * * *